United States Patent [19]

Griebel

[11] Patent Number: 4,841,626

[45] Date of Patent: Jun. 27, 1989

[54] PROCESS FOR FORMING NONLINEAR RESISTANCE TRACKS

[75] Inventor: Franz Griebel, Bad Neustadt/Saale, Fed. Rep. of Germany

[73] Assignee: Preh, Elecktrofeinmechanische Werke, Jakob Preh, Nachf. GmbH & Co., Bad Neustadt/Saale, Fed. Rep. of Germany

[21] Appl. No.: 95,471

[22] Filed: Sep. 11, 1987

[30] Foreign Application Priority Data

Sep. 12, 1986 [DE] Fed. Rep. of Germany ..... 3631057

[51] Int. Cl.[4] ..... H01C 17/06

[52] U.S. Cl. ..... 29/620; 29/613; 118/412; 338/184; 338/199; 427/101; 427/102; 427/286

[58] Field of Search ..... 29/620, 613, 829, 831, 29/835, 412; 427/101, 102, 286; 338/184, 164, 199; 118/412

[56] References Cited

U.S. PATENT DOCUMENTS

| | | | |
|---|---|---|---|
| 2,511,807 | 6/1959 | Packard | 338/141 |
| 3,280,448 | 10/1966 | Brajer | 29/620 |
| 4,335,293 | 10/1982 | Driscoll | 338/184 |
| 4,430,634 | 2/1984 | Hufford et al. | 338/199 |
| 4,463,467 | 8/1984 | Grüber et al. | 427/286 |
| 4,621,250 | 11/1986 | Echasseriu et al. | 338/184 |

FOREIGN PATENT DOCUMENTS

| | | |
|---|---|---|
| 0179917 | 5/1986 | European Pat. Off. . |
| 2546731 | 9/1984 | Fed. Rep. of Germany . |

*Primary Examiner*—P. W. Echols
*Attorney, Agent, or Firm*—Wegner & Bretschneider

[57] ABSTRACT

A process for producing nonlinear resistance tracks on a supporting base should be carried out in such a way that constant transitions are provided between the non-linear resistance sub-ranges. For this purpose the supporting base is moved under a coating device at right angles to the longitudinal direction of the base strips provided whereby this coating device applies several strips of resistance paste onto the supporting base in the wet condition so that they are close to each other. The resistance pastes have different resistance values according to the set non-linear resistance pattern. The base strips are cut out of the supporting base at right angles to its direction of movement.

2 Claims, 2 Drawing Sheets

PROCESS FOR FORMING NONLINEAR RESISTANCE TRACKS

The invention relates to a process for forming resistance tracks on a supporting base which is cut into base strips, whereby the resistance value of the resistance strip follows a nonlinear pattern in the longitudinal direction of the base strip.

The forming of resistance tracks, the resistance value of which follows a nonlinear pattern using the screen printing process is known. When this process is used however sharply defined boundaries are created between the individual sub-ranges of the resistance track. This is undesirable as considerable jumps in the resistance value then occur along the resistance track.

The forming of nonlinear resistance tracks by the consecutive atomomising and depositing of the resistance pastes is also known. This process, however, imposes a load on the surrounding area and results in a high degree of scatter in the resistance of the resistance track. In addition the required master plates have to be constantly prepared.

The production of resistance tracks by allowing drops of resistor ink to trickle onto stamped out base strips is also known. This process is expensive, however, and little suited to mass production. A process is described in European patent EP-O No. 179 917 Al whereby a resistance paste is applied to a supporting base by means of a single nozzle. At the same time this nozzle can be displaced in relation to the supporting base.

A rotary potentiometer is described in U.S. Pat. No. 4,430,634 on which a resistance is arranged on a flexible base strip along the surrounding wall of a cylindrical chamber.

The object of the invention is to propose a process of the type mentioned in the introduction with which resistances can be produced with a nonlinear pattern of the resistance value in an efficient and uniform manner with continuous transitions between the resistance sub-ranges.

The above object is achieved according to the invention with a process of the type mentioned in the introduction, in that the supporting base is run through under a coating device for resistance pastes at right angles to the longitudinal direction of the base strips provided, whereby the coating device applies several strips of resistance pastes in a close arrangement to each other to the supporting base in the wet condition so that their edge zones flow inside each other and whereby the resistance pastes forming the strips of resistance paste have different resistance values corresponding to the nonlinear resistance pattern provided and that the base strips are then cut out of the supporting base coated with the resistance pastes.

As the resistance pastes flow inside each other whilst still in the wet condition and are thereby mixed together, the transitions between the individual resistance values are continuous so that a uniform characteristic curve is obtained. Efficient production is also possible as the strips of resistance paste are continuously applied to a supporting base. The base strips stamped out after the drying out of the resistance pastes are also particularly suitable for the production of very small potentiometers.

The consumption of resistance paste is comparatively small so that this process is not harmful to the environment.

A rotary potentiometer operating with a base strip produced according to the described process is characterised in that the strips of resistance paste are applied to a flexible supporting base and the cut base strip is inserted into a cylindrical inner space of a casing so that it is curved about its longitudinal direction in such a way that it extends around the circumference of the inner space and that a tap is inserted in the inner space.

Further advantageous embodiments of the invention are given by the following description of an example of an embodiment.

The drawings show:

Figure 1:
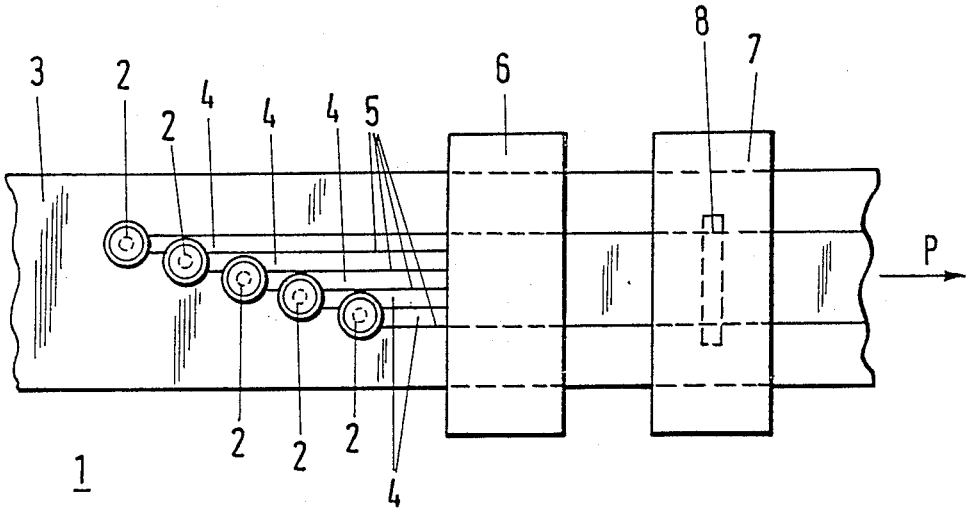
FIG. 1 shows a schematic view of an apparatus for carrying out the process.
Figure 2:
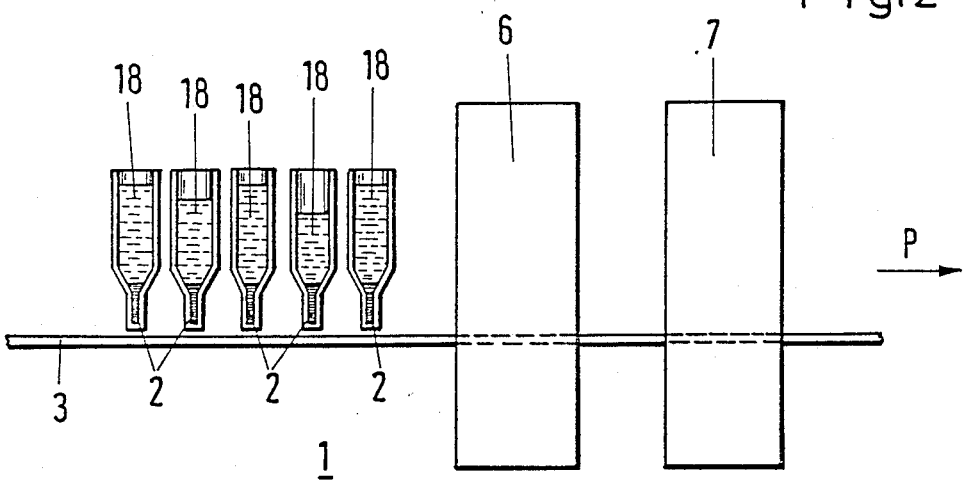
FIG. 2 shows a side view of the apparatus according to FIG. 1.

A coating device (1) is provided which is fitted with a multiplicity of small tubes (2). The tubes (2) are located close to each other in a staggered arrangement and the resistance pastes (18) flow from them onto the supporting base (3). The tubes (2) are supplied with resistance pastes (18) with different resistance values.

A flexible base foil (3) is drawn through below the tubes (2) in the direction of the arrow (P) and at the same time this base foil (3) can be fed by a roller.

The tubes (2) apply strips of resistance paste (4) to the base foil (3) in the wet condition, whereby these flow with their parallel edges (5) inside each other.

After this the base foil (3) coated with the strips of resistance paste (4) flows through a dryer (6). The coated base foil (3) can be rolled up onto a further roller (not shown) and then cut.

Base strips (8) are stamped out of the coated base foil (3) in a cutting device (7). The longitudinal direction of the base strip (8) extends at right angles to the direction of conveying (P) of the base foil (3) or its longitudinal direction. Consequently resistance ranges from all strips of resistance paste (4) are arranged directly next to each other in rows on the base strip (8).

Figure 3:
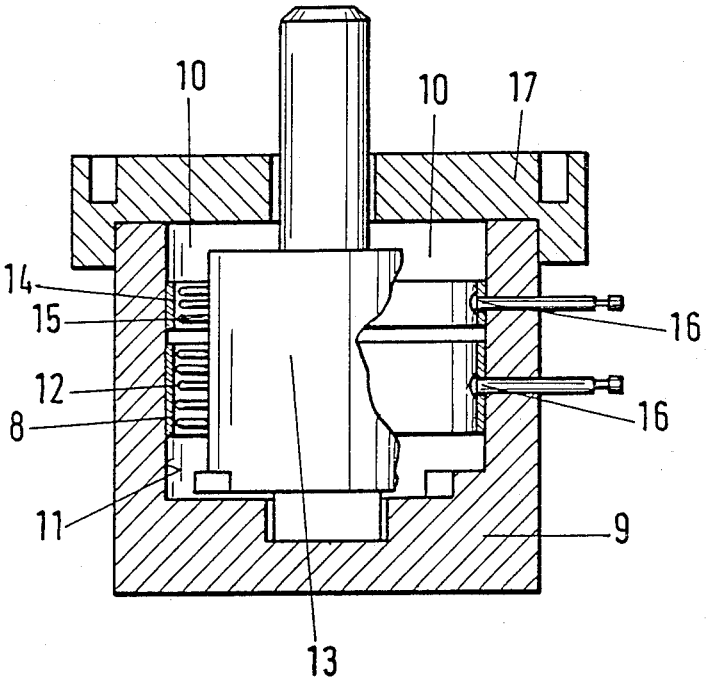
FIG. 3 shows a rotary potentiometer with a resistance produced according to the process.

A rotary potentiometer (see FIG. 3) is provided with a casing (9) with a cylindrical inner space (10). The base strip (8) is inserted so that it is curved into the inner space (10) in such a way that it extends about the circumference of the inner wall (11) of the inner space (10). The base strip (8) is inserted in such a way that sliders (12) of a tap (13) are located on its resistance track. As a result of the flexibility of the base strip (8) a resistance track which is concentric with the axis of rotation of the tap (13) is created, on which the slider (12) is located in the radial direction.

Very small potentiometers can be produced by means of this arrangement of the base strip (8). The inner space (10) can for example have a diameter of less than 7 mm.

Moreover the contact pressure force of the slider (12) on the resistance track is independent of the holding of the tap (13) in the casing (9). As the equipotential lines of the resistance track run parallel to the axis of rotation of the tap (13) and parallel with each other, i.e. they do not run radially to the axis of rotation, a relatively high current-carrying capacity of the resistance track can be achieved.

An additional base strip (14) which is provided with a conducting layer is located at the inner wall (11).

Sliders (15) which are connected to the sliders (12) are located on it. The ends of the conducting track and the resistance track are provided with electrical connections (16). A cap (17) of the casing (9) holds the tap (13) in the casing (9).

Reference list 10/86 Pt.

1 Coating device
2 Small tubes
3 Base foil
4 Strips of resistance paste
5 Edges
6 Dryer
7 Cutting device
8 Base strip
9 Casing
10 Inner space
11 Inner wall
12 Slider
13 Tap
14 Further base strips
15 Slider
16 Connections
17 Cap
18 Resistance paste
19 Arrow

What is claimed is:

1. A process for forming nonlinear resistance tracks for rotary potentiometers, comprising:

feeding a supporting base, made of a flexible strip-shaped foil, under a coating device in a feeding direction;

wet-applying, with said coating device, a plurality of resistance pastes beside each other along said strip-shaped foil so as to form strips extending in said feeding direction, said resistance pastes having different resistance values so as to form a predetermined non-linear resistance pattern in a direction perpendicular to the feeding direction, said resistance pastes flowing inside each other in edge regions after being applied;

drying the resistance pastes located on said strip-shaped foil;

cutting a plurality of base strips out of said strip-shaped foil, said base strips extending in the direction perpendicular to the feeding direction;

curving the plurality of base strips into an annular shape;

arranging each of the annularly-curved base strips in a rotary potentiometer.

2. The process as claimed in claim 1, wherein said step of wet-applying a plurality of resistance pastes is performed using a plurality of small tubes containing resistance paste located in a staggered relationship in said coating device.

* * * * *